US006311899B1

(12) United States Patent
Hidaka et al.

(10) Patent No.: US 6,311,899 B1
(45) Date of Patent: Nov. 6, 2001

(54) NOZZLE DEVICE AND A GUN UNIT IN AN APPARATUS FOR APPLYING ADHESIVE BY SPRAYING IN A SPIRAL FORM

(75) Inventors: Shoji Hidaka; Takayuki Mende, both of Osaka (JP)

(73) Assignee: Kabushiki Kaisha Santuuru, Osaka (JP)

( * ) Notice: Subject to any disclaimer, the term of this patent is extended or adjusted under 35 U.S.C. 154(b) by 0 days.

(21) Appl. No.: 09/463,089

(22) PCT Filed: May 14, 1999

(86) PCT No.: PCT/JP99/02543

§ 371 Date: Feb. 2, 2000

§ 102(e) Date: Feb. 2, 2000

(87) PCT Pub. No.: WO99/59732

PCT Pub. Date: Nov. 25, 1999

(30) Foreign Application Priority Data

May 17, 1998 (JP) ..... 10-152042

(51) Int. Cl.[7] ..... B05B 1/28

(52) U.S. Cl. ..... 239/298; 239/290; 239/601; 239/418

(58) Field of Search ..... 239/290, 292, 239/296, 298, 601, 418, 421, 433, 434.5, 423, 424, 589, 299; 222/575

(56) References Cited

U.S. PATENT DOCUMENTS

| | | | | |
|---|---|---|---|---|
| 1,030,824 | * | 6/1912 | Kent . | |
| 3,754,710 | * | 8/1973 | Chimura | 239/601 |
| 3,886,565 | * | 5/1975 | Kojima | 239/601 |
| 4,570,834 | * | 2/1986 | Ward | 222/575 |
| 4,785,996 | * | 11/1988 | Ziecker et al. | 239/298 |
| 4,957,783 | * | 9/1990 | Gabryszewski | 239/296 |
| 4,969,602 | * | 11/1990 | Scholl | 239/298 |
| 4,970,985 | * | 11/1990 | Slauterback | 239/296 |
| 4,987,854 | * | 1/1991 | Hall | 239/296 |
| 5,194,115 | * | 3/1993 | Ramspeck et al. | 239/298 |
| 5,566,866 | * | 10/1996 | Jacobsen et al. | 222/575 |

FOREIGN PATENT DOCUMENTS

| | | |
|---|---|---|
| H3-146160 | 6/1991 | (JP) . |
| H7-155653 | 6/1995 | (JP) . |
| H8-500767 | 1/1996 | (JP) . |

* cited by examiner

*Primary Examiner*—David A. Scherbel
*Assistant Examiner*—Christopher S Kim
(74) *Attorney, Agent, or Firm*—Koda & Androlia

(57) ABSTRACT

A truncated cone which causes pressurized air flow from plural pressurized air holes to rotate and flow down along the circumferential surface of the truncated cone is provided connectedly at the underside of a nozzle base. A pair of (right and left) downward slanting surfaces which are recessed in V-shape (in side view) are formed in such a fashion that they oppose to each other and slant upward and toward the center. A nozzle projection whose underside is a non-circular shape having a minor axis in the direction where the lower ends of the downward slanting surfaces exist and a major axis in the direction where the lower ends of the downward slanting surfaces do not exist, is provided connectedly at the underside of the truncated cone. In the second invention of the present application, adhesive exposing surface is formed at a part of the downward slanting surface. In the third invention of the present application, the major axis direction of the underside of the nozzle projection is made changeable so as to make the major axis direction of the major axis oval shape (in cross section) selectable.

4 Claims, 8 Drawing Sheets

NOZZLE DEVICE AND A GUN UNIT IN AN APPARATUS FOR APPLYING ADHESIVE BY SPRAYING IN A SPIRAL FORM

SPECIFICATION

A nozzle device and a gun unit in an apparatus for applying adhesive by spraying in a spiral form 1. Technological Field The invention of the present application relates to an apparatus for applying adhesive by spraying in a spiral form.

2. Background of Technology

Regarding the apparatus for applying adhesive by spraying in a spiral form, Tokukaisho No. 63-283774 and Tokukaisho No. 63-283774, for example, have been known to the public. These disclose the apparatus for applying adhesive by spraying in a spiral form, whereby a spiral spray pattern of adhesive fiber is formed by the following process. By causing rotating pressurized air flow (pressurized air flow discharged from a plurality of pressurized air holes arranged concentrically with an adhesive hole) to act on filamentous molten adhesive discharged from an adhesive hole of a nozzle, the filamentous molten adhesive is rotated and stretched into a spiral form.

Besides, Tokukaihei No. 2-227154 and Tokukaihei No. 3-146160 disclose the technological thought of reforming the spiral spray pattern of adhesive fiber from the circular rotation to the elliptical rotation by causing the secondary spiral pressurized air flow to act on the spiral spray pattern of adhesive fiber (formed by causing rotatating pressurized air flow to act on adhesive fiber or filamentous molten adhesive).

The above Tokukaihei No. 2-227154 and Tokukaihei No. 3-146160 disclose the technological thought of reforming the spiral spray pattern of adhesive fiber from the circular rotation to the elliptical rotation, but such technological thought involves the necessity of causing the secondary spiral pressurized air flow to act on adhesive fiber rotating circularly, with the result that construction of the nozzle device becomes complicated.

Furthermore, in order to obtain the desired spiral spray pattern of elliptical rotation, it is required to adjust and control the secondary rotating pressurized air flow and a tip portion of a nozzle must be replaced so as to change the mechanism of supplying the secondary rotating pressurized air flow.

The present invention has for its object to make the spiral spray pattern of adhesive fiber changeable from the circular rotation to the elliptical rotation without complicating the construction of the nozzle device. Another object of the present invention is to make the major axis direction of elliptical rotation changeable so that the adhesive application width is made selectable.

DISCLOSURE OF THE INVENTION

The first invention of the present application is to provide a nozzle device in an apparatus for applying adhesive by spraying in a spiral form, characterized in that it comprises (a) a nozzle base 1 having an adhesive supply hole 11 at the center thereof and a plurality of pressurized air holes 12 arranged concentrically with the adhesive supply hole 11, (b) a truncated cone 2 (in the shape of an inverted truncated cone) connected to the underside of the nozzle base 1, having at the center thereof an adhesive hole 21 connected to the adhesive supply hole 11 of the nozzle base 1 and a circumferential surface positioned at the inner center side from the lower ends of plural pressurized air holes 12, whereby rotating pressurized air flow from plural pressurized air holes 12 is flowed down as it is rotating along the circumferential surface of the truncated cone 2, and (c) a nozzle projection 3 of deformed (partly cut away) conical body or deformed (partly cut away) cylindrical body connected to the underside of the truncated cone 2, having at the center thereof an adhesive agent hole 31 connected to the adhesive supply hole 11 of the truncated cone 2 and a pair of (right and left) opposing downward slanting surfaces Q (the circumferential surface is partially cut away in V-shape in side view), with its upper side being a round shape whose area is almost equal to or smaller than that of the underside of the truncated cone 2 and its under side being a non-circular shape which has a minor axis in the direction where the lower ends of the downward slanting surfaces Q exist and a major axis in the direction where the lower ends of the downward slanting surfaces Q do not exist.

The second invention of the present application provides a nozzle device in an apparatus for applying adhesive by spraying in a spiral form, characterized in that an adhesive exposing surface P is formed at a part of the downward slanting surface Q in the nozzle projection (of the first invention) by exposing an adhesive hole at a tip portion of the downward slanting surface Q.

The third invention of the present application provides a gun unit in an apparatus for applying adhesive by spraying in a spiral form, which is characterized in that a spirally spraying pattern is selectable in the major axis direction of the oval by making the major axis direction of the underside of the nozzle projection changeable.

In applying adhesive agent by an apparatus for spraying adhesive in a spiral form, pressurized air flow discharged from a plurality of pressurized air flow holes flows down along a truncated cone. At this time, in the first invention pressurized air flow turns into rotating pressurized air flow due to eccentricity of the pressurized air hole and acts on a filamentous molten adhesive bead discharged from the adhesive agent hole of the nozzle, whereby spiral adhesive agent fiber is formed. In the first invention of the present application, spiral pressurized air flow is deflected in its rotating direction due to its touching the downward slanting surface Q of the nozzle projection when it flows down circularly along the truncated cone. Consequently, spiral spraying pattern of adhesive fiber turns elliptical in a section.

In the second invention of the present application, molten adhesive agent flowing down through an adhesive agent hole of the nozzle projection is preliminarily stretched by making the rotating pressurized air flow act partly on molten adhesive agent flowing down through an adhesive agent hole of the nozzle projection and as a result, a spiral spraying pattern of adhesive agent fiber is rotated at high speed in elliptical form in a section.

In the third invention of the present application, the direction of a major axis at the under side of the nozzle projection is changed to the desired direction by turning the nozzle unit (by which spiral spray pattern of adhesive agent fiber is made oval in a section in the first invention) in relation to the gun base of the gun unit and as a result, the major axis direction of the spiral spray pattern is changed to the desired direction and thus spiral spraying is done by a spiral spray pattern of oval cross section having the desired major axis direction.

THE BEST FORM FOR EMBODYING THE PRESENT INVENTION

Figure 3:
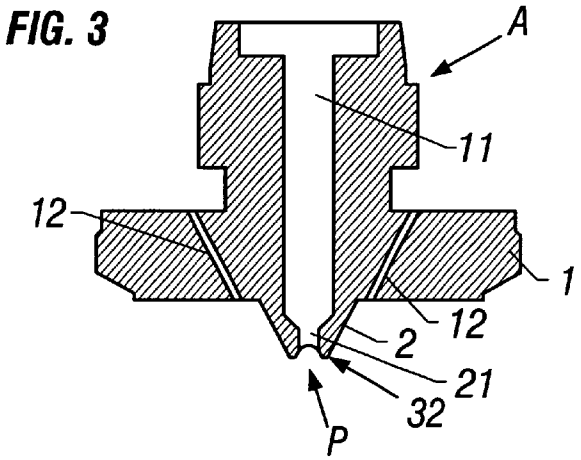
FIG. 3 is a cross-sectional view of the nozzle in FIG. 1.
Figure 4:
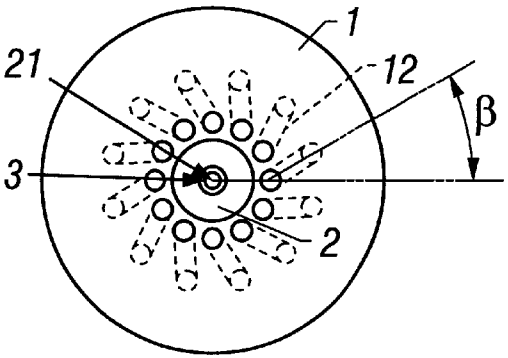
FIG. 4 is a bottom view of the nozzle in FIG. 1.
Figure 1:
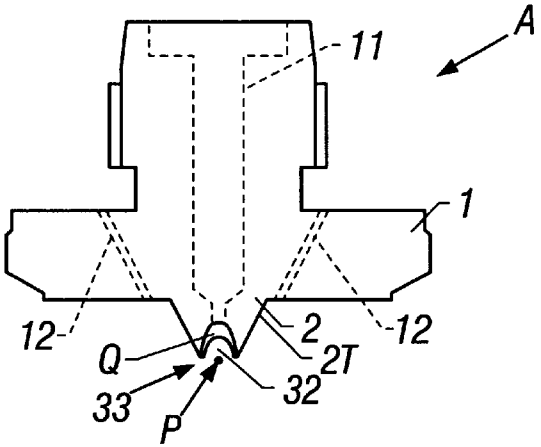
FIG. 1 is a front view of the nozzle according to the first invention of the present application.
Figure 2:
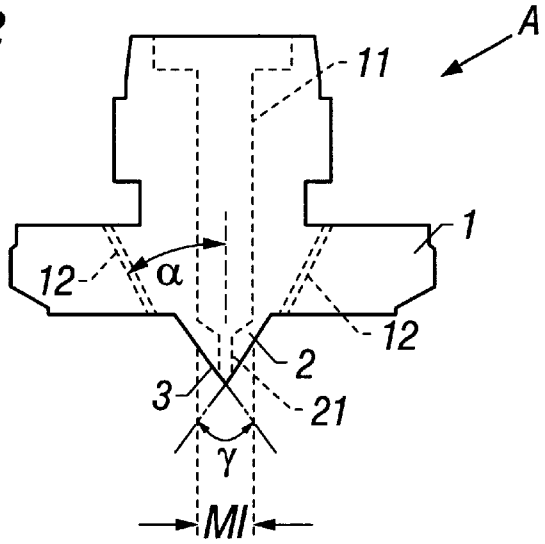
FIG. 2 is a side view of the nozzle in FIG. 1.
Figure 7:
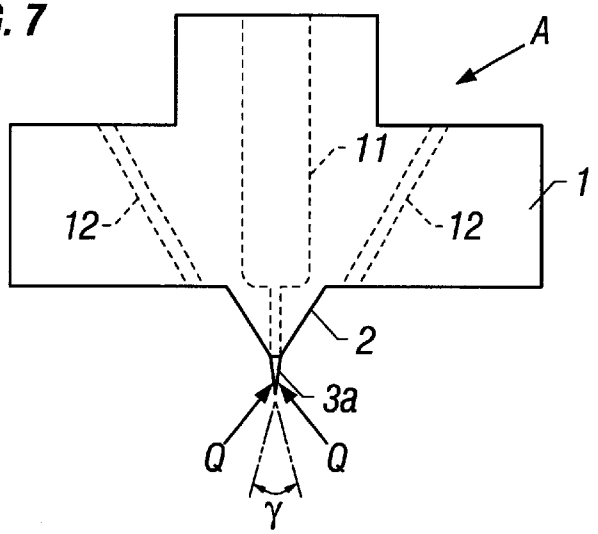
FIG. 7 is a side view of the nozzle in FIG. 6.
Figure 8:
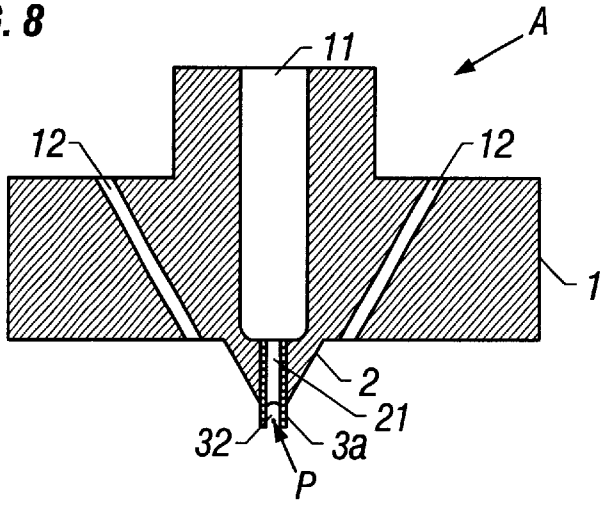
FIG. 8 is a cross sectional view of the nozzle in FIG. 6.

In order to explain the present invention more in detail, the present invention is described below with reference to the attached drawings.

A nozzle device A is composed of a nozzle base 1, a truncated cone 2 and a nozzle projection 3.

The nozzle base 1 comprises an adhesive supply hole 11 at the center thereof and a plurality of pressurized air holes 12 arranged concentrically with the adhesive supply hole 11. The plural pressurized air holes 12 are formed at a tilt angle $\alpha$ and at a rotary angle (eccentric angle) $\beta$ in relation to the nozzle base 1.

The truncated cone 2 is connected to the underside of the nozzle base 1 and has at the center thereof an adhesive hole 21 connected to the adhesive supply hole 11 of the nozzle base 1. The truncated cone 2 takes the shape of an inverted truncated cone and has a circumferential surface at the inner center side from the lower ends of plural pressurized air holes 12. In order to make pressurized air flow from the plural pressurized air holes 12 of the nozzle base 1 flow down spirally along the circumferential surface of the truncated cone 2, the truncated cone 2 takes the shape of inverted truncated cone.

The nozzle projection 3 is connected to the underside of the truncated cone 2 and has at the center thereof an adhesive hole 31 connected to the adhesive hole 21 of the truncated cone 2.

The nozzle projection 3 can be formed by treating a tip portion of the truncated cone 2 but can also be formed by setting a slender tube 3*a* in a tip portion of the truncated cone 2 in such a fashion that it is partially exposed.

Formed at the nozzle projection 3 are a downward slanting surface Q (for embodying the first invention of the present application) and an adhesive exposing surface P (for embodying the second invention of the present application). In the first embodiment shown by FIG. 1–FIG. 5, an U-shaped opening 32 (a tip portion 2T of the conical projection 2 is cut in V-shape) or an adhesive exposing surface P and a slant plane 33 (around the V-shaped opening 32) or a downward slanting surface Q are formed. More particularly, the nozzle projection 3 is partially cut away in V-shape (in side view) so as to form a pair of (right and left) opposed downward slanting surfaces Q whose upper side being a round shape having the area equal to or smaller than that of the underside of the truncated cone 2 and whose underside being a non-circular shape having a minor axis MI in the direction where the lower ends of the downward slanting surfaces Q exist and a major axis MA in the direction where the lower ends of the downward slanting surfaces Q do not exist. Thus, a nozzle projection 3 in the shape of a deformed conical body (partially cut away) or a deformed cylindrical body (partially cut away) is composed.

In the second embodiment shown by FIG. 6–FIG. 10, a slender tube 3*a* is inserted in the adhesive hole 21 of the truncated cone 2 so that the nozzle projection 3 is composed by a part of the slender tube 3*a* projecting from the tip of the truncated cone 2. The tip portion of the slender tube 3*a* is cut away in V-shape so as to form the U-shaped opening or the adhesive exposing surface P and a slant plane 33 or the downward slanting surface Q is formed around the U-shaped opening.

Figure 5:
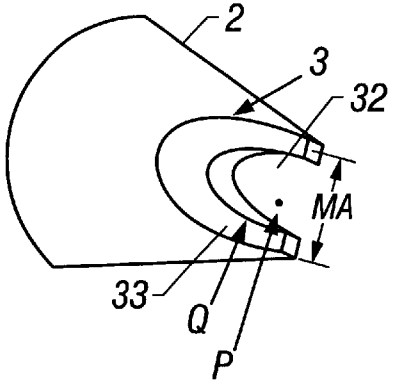
FIG. 5 is a perspective view, on an enlarged scale, of the deformed cylindrical part.
Figure 6:
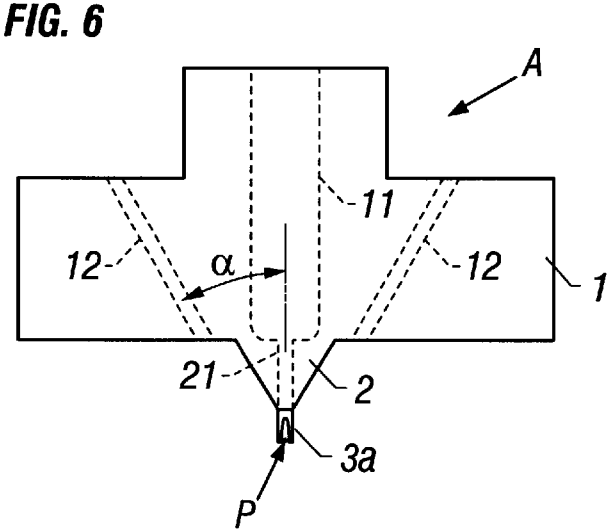
FIG. 6 is a front view of the nozzle according to the second embodiment of the present invention.
Figure 9:
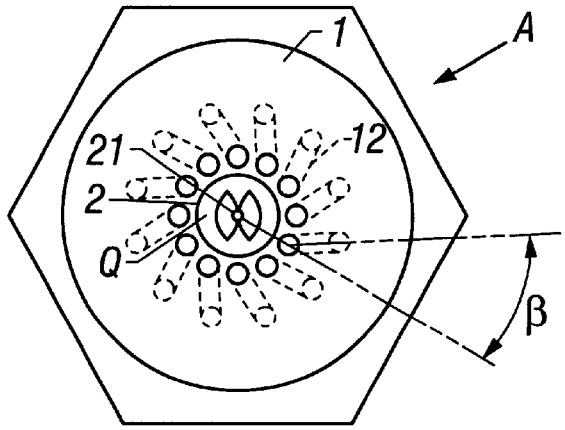
FIG. 9 is a bottom view of the nozzle in FIG. 6.
Figure 10:
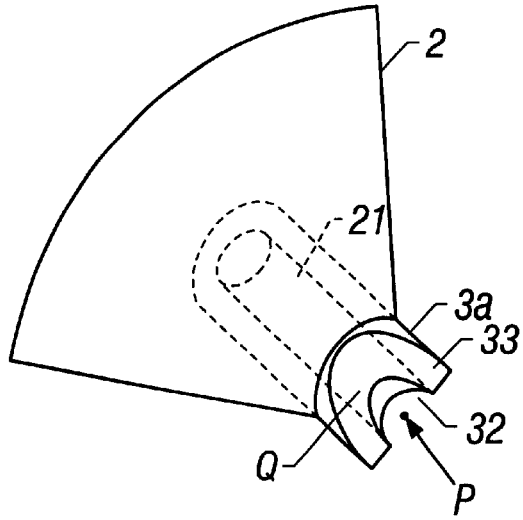
FIG. 10 is a perspective view, on an enlarged scale, of the deformed cylindrical part.

FIG. 5 and FIG. 10 show the nozzle projection 3 in the first embodiment and the second embodiment respectively, on an enlarged scale, and also show the adhesive exposing surface P and the downward slanting surface Q. The U-shaped pressurized air flow touching surface Q is connected to the tip portion of the truncated cone 2.

The angle $\alpha$ of the tip of V-shape should preferably be small but if it is less than 30 degree, two claws at the tip of V-shape will become weak in strength and easy to be damaged and if it is more than 90 degree, the effect of the present invention will become little. Therefore, the angle of the tip should preferably be around 45 degree.

The caliber of a discharge orifice of the adhesive hole 21 is selected chiefly in consideration of the viscosity of adhesive. A smaller caliber of the discharge orifice will afford easiness of adhesive stretching and higher rotating speed. However, if the caliber is too small, pressure of pushing out adhesive will become too high and will give large burden to the apparatus. Therefore, the caliber should be selected in due consideration of the viscosity and discharging quantity of adhesive, pressure-resistance of the apparatus, etc. Generally, the caliber within the range of 0.4 mm–0.6 mm is preferable.

Figure 11:
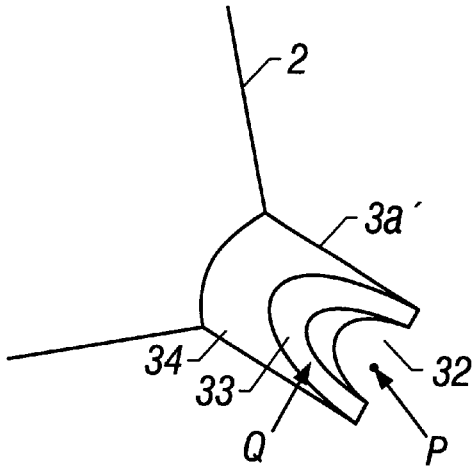
FIG. 11 is a perspective view, on an enlarged scale, of the deformed cylindrical part of the nozzle according to the third embodiment of the present invention.

In the third embodiment shown by FIG. 11, a tubular surface 34 exists between a tip of the slanting plane 33 and a connection part between the truncated cone 2 and the nozzle projection 3*a'*.

In the second embodiment and the third embodiment, the slender tube 3*a* is arranged connectedly at the tip of the truncated cone 2 but the truncated cone 2 and the nozzle projection 3 can be formed in a body by forming a deformed tubular portion at the tip of the truncated cone 2.

Figure 12A:
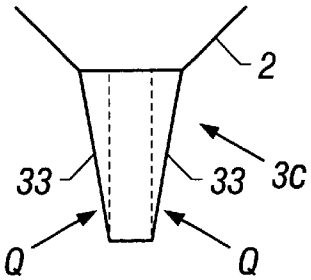
FIG. 12 shows the nozzle according to the fourth embodiment of the present invention, in which (a) is a front view, (b) is a bottom view, and (c) is a perspective view, on an enlarged scale, of the deformed cylindrical part.
Figure 12B:
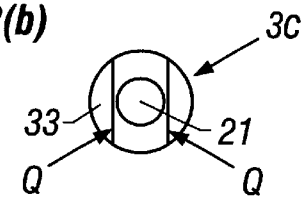
Figure 12C:
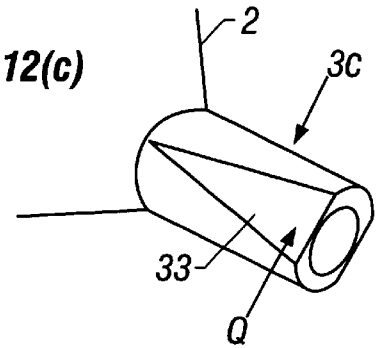

In the fourth embodiment shown by FIG. 12, a nozzle projection 3*c* has a slant plane 33 for forming the downward slanting surface Q (for embodying the first embodiment) but does not have an U-shaped opening 32 for forming the adhesive exposing surface P (for embodying the second invention).

In the present invention, when adhesive is sprayed for application, pressurized air flow from a plurality of pressurized air holes runs down as it is rotating along the conical projection due to eccentricity of the pressurized air holes and acts on filamentous adhesive bead discharged from the adhesive hole of the nozzle and thus spiral adhesive fiber is formed. At this time, pressurized air flow makes contact with running down molten adhesive at the adhesive exposing surface of the conical projection and imparts stretching action to molten adhesive. Consequently, spiral adhesive fiber is rotated at high speed. Rotating direction of pressurized air flow is deflected when pressurized air flow running down as it is rotating along the conical projection makes contact with the pressurized air flow touching surface and consequently rotating pressurized air flow presents elliptical shape in a section and spiral spray pattern of adhesive fiber takes the elliptical shape in a section. In this way, adhesive rotates at high speed as it is turning into a slender filament and is piled up in elliptical shape.

Therefore, even if an object to which adhesive is applied is moved at low speed, difference in adhesive application quantity between both ends part and a central part of the application width will be very little. Also, as compared with a conventional nozzle, the present invention affords easiness of adhesive stretching and therefore adhesive can be rotated at higher speed. Furthermore, if viscosity of adhesive and pressure of gas for rotating (pressurized air flow) are adjusted, adhesive branches into two flows at the tip of the nozzle and rotates elliptically in the form of slenderer filament. Therefore, even if an object for which adhesive is applied is moved at high speed, fine adhesive application is possible.

An explanation is made below about three principles and effects of the present invention.

The first is the so-called "Coanda effect" which is obtained by such property of gas that when gas bursts forth at high speed, it tends to flow along the near-by wall surface. In the present invention, gas vomitted for rotating and stretching purposes flows firstly along a conical projection at the center of a nozzle and then a part of the gas flows along a slanting surface at the V-shaped tip. From the fact that gas which touched more the V-shaped slanting surface deflects more strongly and that the V-shaped slanting surface is of right and left symetric type, in the present invention gas will naturally rotate in elliptical shape of extremely minor axis. The longer the V-shaped slanting surface (namely, the smaller the angle of V-shape), the more the "Coanda effect" acts stably.

The second is easiness of stretching and possibility of high-speed rotation by providing a preliminary running section. The speed at which adhesive is vomitted from a discharge hole is usually several cm/second. On the other hand, the initial velocity of air flow which touches adhesive is 200–300 m/second. Adhesive receives stretching action from such air flow and is stretched finally at the speed of scores meters/second. Thus, adhesive receives abrupt stretching action as soon as it is discharged from the discharge hole and under such environment, adhesive shows strong tensile strength and consequently stretching force is reduced. In the present invention, however, adhesive makes contact with air flow initially at the U-shape compressed part provided at the tip of the discharge hole and is stretched to some extent before it departs from claws at the tip of the nozzle. Thus, by making adhesive flow preliminarily at the U-shape compressed part, stretching thereafter can be effected strongly and high-speed rotation is made possible.

Figure 13:
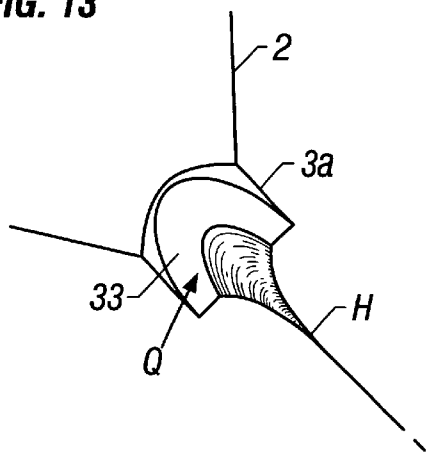
FIG. 13 shows the flow of adhesive at the V-shaped tip portion according to the present invention.
Figure 14:
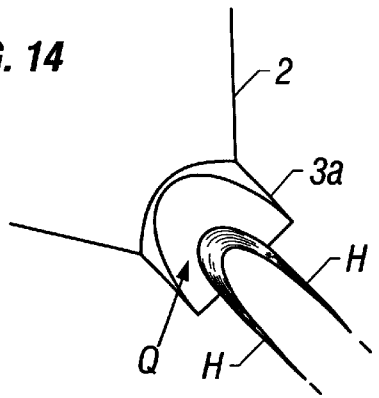
FIG. 14 shows that adhesive flows as it forks into two, at the V-shaped tip portion.

The third is the most basic property in the flow of viscous fluid, namely, "Couette flow", "Poiseuille flow", etc. in theoretical formula. These formulae are, in a word, "The more the viscous fluid approaches the standing wall surface, the more the speed of it reduces". In the present invention, adhesive discharged from one adhesive discharge hole touches firstly high-speed air flow at the bottom of the V-shape recessed part and is subjected to strong stretching action. However, at this time, adhesive is partly still in contact with two claw portions of the V-shape recessed part (standing wall surface) and therefore adhesive flows in such a fashion as shown by FIG. 13 or as shown by FIG. 14 according to the relation between the viscosity and stretching strength by surrounding air flow. In the case of carrying out careful application to an object moving at high speed , the process shown by FIG. 14, namely, the condition under which adhesive flows in two branches should be employed.

Experimental examples and comparative examples are explained below.

Experimental Example 1

For the nozzle of the second embodiment, the following conditions were employed.

The number of air holes=12

Diameter of the air hole=0.5 mm

Pitch diameter of the air hole=4.5 mm

Angle of inclination of the air hole=30°

Angle of rotation of the air hole=22°

Diameter of the base part of conical projection=2.7 mm

Height of conical projection=2 mm

Expanding angle of conical projection=50.8°

Inside diameter of slender tube=0.5 mm

Outside diameter of slender tube=0.8 mm

Angle of the tip of slender tube=45°

Projecting length of slender tube=1.0 mm

Adhesive used was hot melt synthetic rubber whose viscosity at 160° C. being 4 Pa-s (Pascal second). The adhesive was discharged at the rate of 20 g/min. at 160° C. For rotating and stretching adhesive, air was supplied at 180° C. in temperature and 0.8 N=m3/Hr. in flux.

Polyester fiber was used as an object to which adhesive is applied and was run at 50 m/min. at the position 30 mm below the nozzle.

Figure 15:
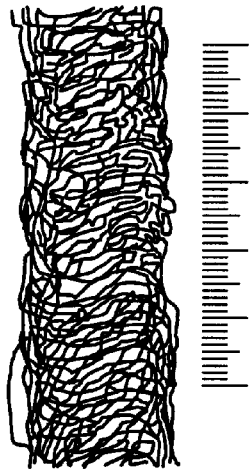
FIG. 15 shows an application pattern obtained by experimental example 1.

The pattern of adhesive applied is shown in FIG. 15. The application width was 23 mm. Adhesive was applied uniformly both in width direction and in running direction. Swelling of adhesive at both ends in width direction was not observed.

Experimental Example 2

Film (to which adhesive is applied) was run at 150 m/min. The other conditions were quite the same as in the case of Experimental example 1.

Figure 16:
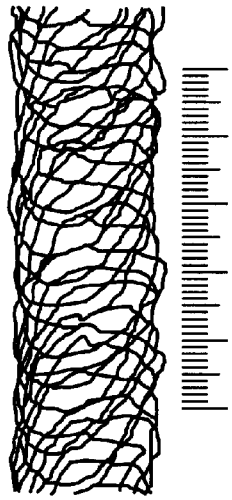
FIG. 16 shows an application pattern obtained by experimental example 2.

The pattern of adhesive applied is shown in FIG. 16. The application width was 23 mm. As the method of evaluating the fineness of application at the middle part of application width, number (n) of filaments which cross a section (L=50 mm) of a center line of application width was counted. Then, L was divided by n and the result obtained was named tentatively "opening of mesh". In this experimental example, "opening of mesh" was 1.6 mm.

Experimental Example 3

Film (to which adhesive is applied) was run at 300 m/min. The other conditions were quite the same as in the case of Experimental Example 1.

Figure 17:
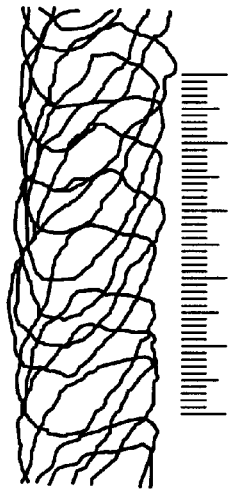
FIG. 17 shows an application pattern obtained by experimental example 3.

The pattern of adhesive applied is shown in FIG. 17. Application width was 23 mm and "opening of mesh" was 3.2 mm.

Experimental Example 4

Flux of air for rotation was increased to 1.1 N-m3/Hr. The distance from the tip of nozzle to film (to which adhesive is applied) for regulating the application width was 25 mm. The other conditions were quite the same as in the case of Experimental Example 1.

Figure 18:
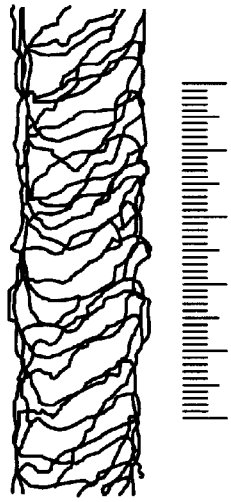
FIG. 18 shows an application pattern obtained by experimental example 4.

The pattern of adhesive applied is shown in FIG. 18. Application width was 23 mm. The "opening of mesh" was 2.2 mm. In Experimental Example 2, Experimental Example 3 and Comparative Example 2 (to be mentioned later), filament of adhesive is composed by one line of loop but in this experimental example, filament of adhesive is composed by 2 lines of loop and it can be confirmed that adhesive forks into two at the tip of the nozzle.

Comparative Example 1

A nozzle of conventional type was used, namely, the nozzle does not have a V-shape slender tube at its tip (refer to Experimental Example 1) and the conical projection at the central part is 2 mm in height, 0.8 mm in the diameter of its tip and is provided with a circular discharge hole of 0.5 mm caliber at its center. The distance from the tip of the nozzle to a film to which adhesive is applied was 18 mm. The other conditions were the same as in the case of Experimental Example 1.

Figure 19:
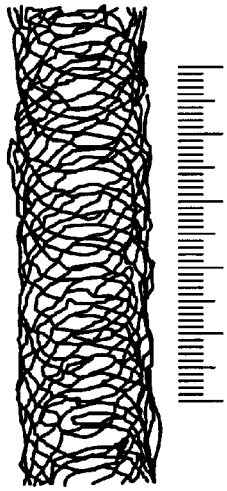
FIG. 19 shows an application pattern obtained by comparative example 1.

The pattern of adhesive applied is shown by FIG. 19. Adhesive application width was 22 mm. As compared with Experimental Example 1, adhesive swelled thickly at both ends of adhesive application width, namely, uneven adhesive application was observed.

Comparative Example 2

A film to which adhesive is applied was run at 150 m/min. The other conditions were the same as in the case of Comparative Example 1.

Figure 20:
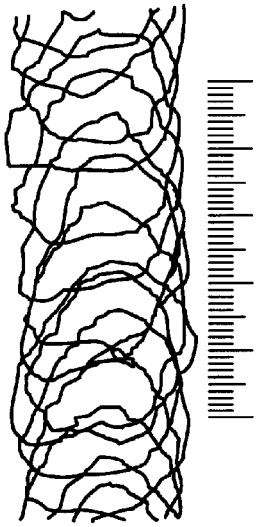
FIG. 20 shows an application pattern obtained by comparative example 2.

The pattern of adhesive applied is shown by FIG. 20. The "opening of mesh" was 3.1 1mm. As compared with Experimental Example 2, "opening of mesh" was coarse. Uniform application cannot be expected.

An explanation is made below about the third invention of the present application.

Figure 22:
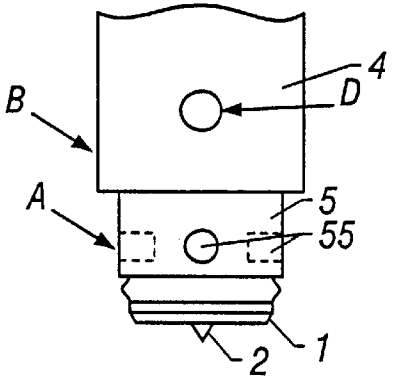
FIG. 22 is a partial front view of the gun unit in FIG. 21.
Figure 21:
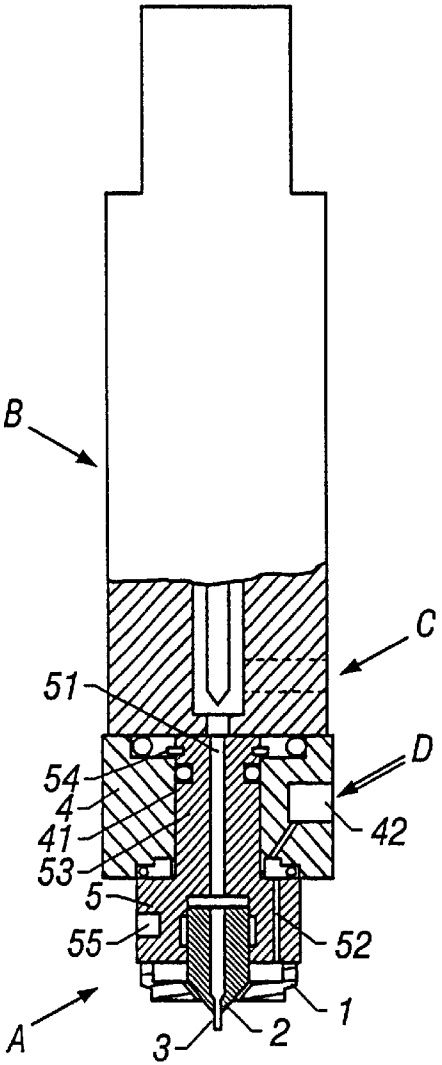
FIG. 21 shows a partial cross section of the gun unit according to the embodiment of the third invention of the present application

In the third invention, the nozzle base 1 of the nozzle device A and the gun base 4 of the gun unit B are changeable in relative position in rotation direction (viewed in transverse section). In the embodiment of the third invention shown in FIG. 21 and FIG. 22, the nozzle base 1 is screwed to a revolution adjusting block 5, a tubular part 51 of the revolution adjusting block 5 is inserted in an inner chamber 41 of the gun base 4 and a ring 52 is provided. Thus, the revolution adjusting block 5 and the gun base 4 are put in interlocked state, namely, the nozzle device A is revolvable in relation to the gun unit B.

The revolution adjusting block 5 is provided with an adhesive hole 51 communicating with a valve mechanism b of the gun unit B and a pressurized air hole 52 communicating with a pressurized air chamber 42. A concaved part 55 for operating revolution is formed at a circumferential surface of the revolution adjusting block 5. Hot melt adhesive agent is supplied to the valve mechanism of the gun unit B through the medium of a hose C (for supplying hot melt adhesive agent) and pressurized air is supplied to the pressurized air chamber 42 through the medium of a pressurized air supply hose D.

Figure 23:
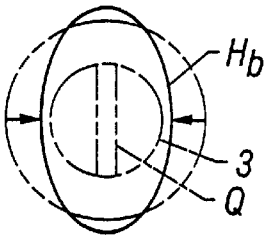
FIG. 23 is an explanatory drawing of the application pattern according to the third invention of the present application.

In the first invention of the present application, as shown by FIG. 23, a spiral spray pattern changes into oval shape Hb when adhesive flow touches the downward slanting surface Q of the nozzle projection 3. In this case, a major axis direction of the oval shape of spiral spray pattern is in the direction where the downward slanting surface of the nozzle projection 3 does not exist but a minor axis direction of the oval shape is in the direction where the downward slanting surface Q of the nozzle projection 3 exists.

Figure 24A:
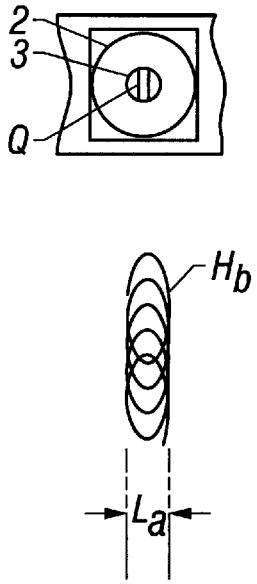
FIG. 24 is an explanatory drawing, showing the change of application width according to the third invention of the present application.
Figure 24B:
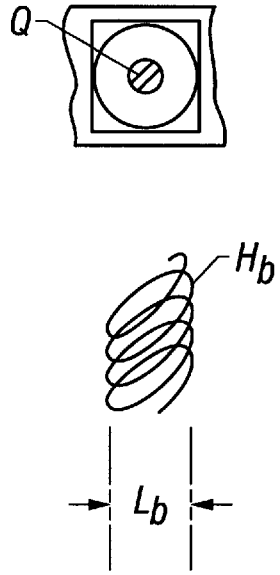
Figure 24C:
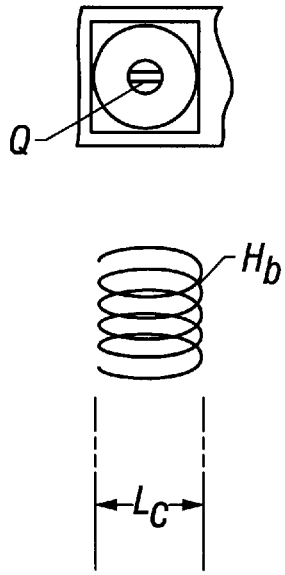

Therefore, with reference to FIG. 24, adhesive application width becomes the shortest La by making the major axis direction of the oval shape of the spiral spray pattern in parallel with the running direction of an object to which adhesive is applied and adhesive application width becomes the largest Lc by making the major axis direction cross at right angles the direction in which an object to which adhesive is applied is carried. The adhesive application width becomes medium Lb by making the major axis direction cuts the running direction of an object to which adhesive is applied at 45°

Figure 25A:
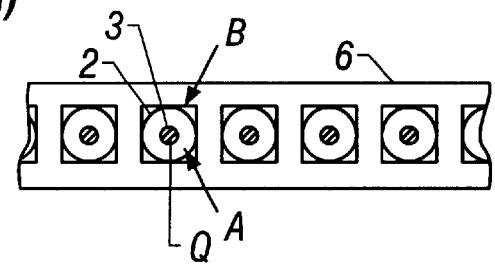
FIG. 25 is an explanatory drawing, showing many gun units arranged linearly.
Figure 25B:
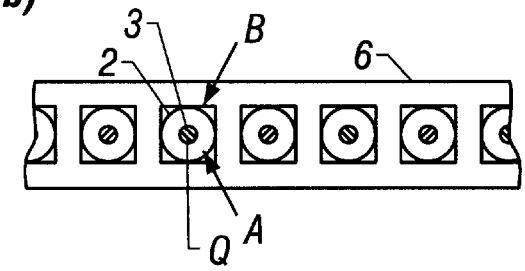
Figure 26:
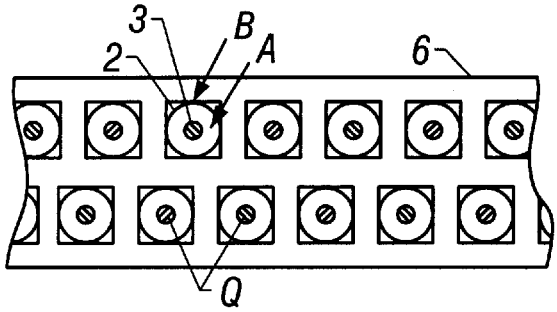
FIG. 26 is an explanatory drawing, showing many gun units arranged linearly and zigzag.

As shown in FIG. 25 and FIG. 26, adhesive application width can be enlarged by providing a support body 6 (erected on the adhesive application line in the direction crossing at right angles or crossing the running direction of an object to which adhesive is applied) with many gun units B.

Various adhesive application patterns can be obtained by selecting the direction of the downward slanting surface Q of the nozzle projection 3, by combining the downward slanting surfaces Q in different directions and by combining downward slanting surfaces Q of the nozzle projection 3 arranged zigzag in two rows (FIG.26).

In the first invention of the present application, the spiral spray pattern of adhesive fiber is made oval in a section by deviating the rotation direction of rotating pressurized air flow flowing down along the truncated cone and touching the downward slanting surface Q of the nozzle projection. Therefore, selection of the major axis direction of the oval in cross section can be changed easily and accordingly, it is easy to select adhesive application width and to select or change the adhesive application pattern, without replacing the tip portion of the nozzle.

Furthermore, there is no need of making the pressurized air flow act on the secondary rotating pressurized air flow (as in the case of known technology) and therefore the construction of the nozzle device is simple, as compared with the known technology.

In the second invention, in addition to the first invention, spiral spray pattern of adhesive fiber can be rotated at high speed by preliminarily stretching molten adhesive agent flowing down the adhesive hole of the nozzle projection (by making molten adhesive flowing down the adhesive hole of the nozzle projection touch partially the rotating pressurized air flow). Also, minute adhesive pattern can be obtained.

In the third invention of the present application, the gun base of the gun unit is provided with the nozzle device (of the first invention) in such a fashion that the major axis direction of the underside of the nozzle projection is changeable so that the major axis direction of the major axial oval of the spiral spray pattern is selectable. Accordingly, an adhesive spiral spray application apparatus which affords easiness of selection of application width and also selection and change of application pattern can be obtained.

POSSIBILITY OF INDUSTRIAL UTILIZATION

As mentioned above, the nozzle device and the gun unit according to the present invention make it possible to make the spiral spray pattern of adhesive fiber changeable from the circular rotation to the oval rotation by applying them to the spiral spray application apparatus, without the necessity of complicating the construction of the nozzle device. Also, major axis direction of the oval rotation is changeable and accordingly adhesive application width is made selectable.

What is claimed is:

1. A nozzle device for applying adhesive by spraying in a spiral spray pattern of adhesive fiber comprising:

(a) a nozzle base having an adhesive supply hole at a center thereof and a plurality of pressurized air holes arranged concentrically with said adhesive supply hole, (b) an inverted truncated cone connected to an underside of said nozzle base, having at a center thereof an adhesive hole connected to said adhesive supply hole and located at an inner center side from lower ends of said plurality of pressurized air holes, whereby pressurized air flow from said plurality of pressurized air holes is rotated and flowed down along a circumferential surface of the inverted truncated cone, (c) a nozzle projection of partly cut away conical form or partly cut away tubular form connected to an underside of the inverted truncated cone, having at a center thereof an adhesive hole connected to the adhesive hole of the inverted truncated cone and a pair of opposed downward slanting surfaces whose upper side is a round shape having an area which is substantially equal to or less than that of the underside of the inverted truncated cone and whose underside is a non-circular shape having a minor axis in a direction where lower ends of the downward slanting surfaces exist and a major axis in a direction where the lower ends of the downward slanting surfaces do not exist, said opposed downward slanting surfaces converging relative to each other in a direction of the pressurized air flow, and (d) an adhesive exposing surface formed at a part of the downward slanting surface by exposing an adhesive hole at a tip portion of the downward slanting surfaces, whereby rotating pressurized air flow flowing down as it rotates along a circumferential surface of the truncated cone and around a circumference of the nozzle projection partially touches the downward slanting surfaces so as to deviate its rotating direction and to rotate a spiral spray pattern of adhesive fiber in elliptical form and also rotating pressurized air flow partially touches adhesive flowing down from the adhesive hole of the nozzle projection so as to stretch it preliminarily and to rotate the spiral spray pattern of adhesive fiber at high speed in elliptical form.

2. The nozzle device according to claim 1, wherein said opposed downward slanting surfaces are cut away in V-shape in side views.

3. An apparatus for applying adhesive by spraying in a spiral spray pattern of adhesive fiber characterized in that it includes:

a nozzle device for applying adhesive by spraying in a spiral spray pattern of adhesive fiber comprising:

(a) a nozzle base having at a center thereof an adhesive supply hole and a plurality of pressurized air holes arranged concentrically with said adhesive supply hole, (b) an inverted truncated cone connected to an underside of said nozzle base, having at a center thereof an adhesive hole connected to said adhesive supply hole and located at an inner center side from lower ends of said plurality of pressurized air holes, whereby pressurized air flow from said plurality of pressurized air holes is rotated and flowed down along a circumferential surface of the inverted truncated cone, and (c) a nozzle projection of partly cut away conical form or partly cut away tubular form connected to an underside of the inverted truncated cone, having at a center thereof an adhesive hole connected to the adhesive hole of the inverted truncated cone and a pair of opposed downward slanting surfaces whose upper side is a round shape having an area which is substantially equal to or less than that of the underside of the inverted truncated cone and whose underside is a non-circular shape having a minor axis in a direction where lower ends of the downward slanting surfaces exist and a major axis in a direction where the lower ends of the downward slanting surfaces do not exist, said opposed downward slanting surfaces converging relative to each other in a direction of the pressurized air flow, and a gun unit having a gun base coupled to said nozzle base such that both are changeable in relative position in rotation direction and major axis direction of the underside of the nozzle projection of the nozzle device is selectable, whereby rotating pressurized air flow flowing down as it is rotating around the nozzle projection partially touches the downward slanting surfaces of the nozzle projection so as to deviate its rotating direction and turn the spiral spray pattern of adhesive fiber into elliptical form and makes the major axis direction of the elliptical form selectable.

4. The nozzle device according to claim 3, wherein said opposed downward slanting surfaces are cut away in V-shape in side view.

* * * * *